US006041970A

United States Patent [19]

Vogel

[11] Patent Number: 6,041,970

[45] Date of Patent: Mar. 28, 2000

[54] PRE-MIX BEVERAGE DISPENSING SYSTEM AND COMPONENTS THEREOF

[75] Inventor: James D. Vogel, Anoka, Minn.

[73] Assignee: IMI Cornelius Inc., Anoka, Minn.

[21] Appl. No.: 08/920,957

[22] Filed: Aug. 29, 1997

Related U.S. Application Data

[60] Provisional application No. 60/024,961, Aug. 30, 1996.

[51] Int. Cl.[7] ..... B67D 5/56

[52] U.S. Cl. ..... 222/129.1; 251/120

[58] Field of Search ..... 222/129.1; 251/120, 251/121

[56] References Cited

U.S. PATENT DOCUMENTS 2,125,102 7/1938 Cornelius ..... 251/120 X 2,202,179 5/1940 Welty et al. ..... 251/120

3,502,111 3/1970 Hansen ..... 251/120 X

*Primary Examiner*—Gregory L. Huson

*Attorney, Agent, or Firm*—Sten Erik Hakanson

[57] ABSTRACT

A premix beverage system is shown including an improved pre-mix tank and pre-mix valve. The tank includes a bag therein for retaining the beverage. Pressure is applied in the tank to provide the motive force to compress the bag and thereby move the beverage from the tank to a dispense point. The present invention also shows a method for converting existing pre-mix tanks to this modified bag containing configuration. A pre-mix valve is shown having a modified control shaft and compensator for reducing turbulence and increasing laminar flow of a carbonated beverage flowing there through for reducing carbonation loss from the beverage. A modified pre-mix valve is also shown that facilitates one handed operation thereof.

10 Claims, 12 Drawing Sheets

30
46
47
48d
58
58
46c
46a
52
60
40
62
64
46b
49
36
66
48
38
32
44
31

80
82
83
84
86
87
88
90
94
95
98
100
102
108
110
112
114a
114b
116
118
A 120
122
124
125a
125b
126
127a
128
130
134
136
140
141
142
144
146
147
148
150
152
154a
154b
158
B

PRE-MIX BEVERAGE DISPENSING SYSTEM AND COMPONENTS THEREOF

This application claims the benefit of U.S. Provisional application Ser. No. 60/024,961, filed Aug. 30, 1996.

FIELD OF THE INVENTION

The present invention relates generally to beverage dispensing systems, and more specifically to pre-mix beverage dispensing systems and components thereof.

BACKGROUND OF THE INVENTION

Carbonated beverages consist of carbonated water and a syrup flavoring combined together in a desired ratio. In post-mix beverage dispensing systems the syrup and carbonated water are mixed at the time of dispense, whereas in pre-mix systems, a previously blended carbonated drink is dispensed from a container holding a volume thereof. Since the pre-mix beverage is produced at a bottling facility, it has the advantage of high quality in terms of accurate carbonation level, ratioing and high water purity. However, since carbonated beverages are typically five parts carbonated water to one part syrup, pre-mix suffers from the disadvantage of requiring the transportation of large volumes of water. Thus, post-mix dispensing, where "local" water is utilized and carbonated on sight, has a cost advantage over time, especially in high volume permanent dispensing locations. Nevertheless, pre-mix systems are very desirable in low volume and temporary special events locations, where water quality is low, and as pre-mix dispensing equipment is less expensive and generally more portable than post-mix equipment.

However, a problem with pre-mix dispensing concerns the uptake of $CO_2$ into the beverage in excess of the desired level during the time the beverage remains in its container. This uptake occurs due to the fact that pressurized $CO_2$ is used as the motive force to move the beverage from its container to a cooling dispenser and ultimately out a pre-mix dispense regulating valve and into the cup being filled. As a result, if the beverage is in physical contact with the pressurized $CO_2$ for a long enough period of time, over carbonation will result. Consequently, when dispensed, such an overly carbonated beverage has a much increased tendency to foam. Excessive foaming wastes beverage and causes delays in filling a cup to its proper level.

Pre-mix beverage dispensing systems, as indicated above, use valves to provide for the on/off regulation of the dispensing of the pre-mixed beverage. As is understood in the art, a carbonated beverage is relatively delicate in that pressure changes and turbulation thereof can cause the carbon dioxide component to come out of solution, thereby resulting in a flatter less carbonated drink than is desired. Thus, where for example, a fresh container of pre-mix is being used wherein $CO_2$ uptake has not occurred to any significant extent, it is desirable to have a pre-mix dispensing valve that serves to minimize any such carbonation loss attributable to its dispensing function. Unfortunately, the uptake of $CO_2$ discussed above is usually in excess of what the dispensing process will remove as the beverage flows through the valve and into the cup. In any event, the overlap in time during which both processes may negate each other would be fleeting and otherwise completely uncontrollable. Thus, a valve that minimizes carbonation loss attributable to its function would be desirable.

It is also understood that pre-mix valves require the holding or placement below the nozzle thereof of a cup followed by manipulation of an upward extending control lever located on top of the valve. Typically, this process requires two hands wherein one hand holds the cup and properly positions it beneath the nozzle, while the other operates the lever. Or alternately, at least requires the placement of the cup on a rest below the nozzle, followed by the manipulation of the valve control lever. It is desirable to have a valve that permits one handed operation wherein the cup can be held beneath the nozzle and the valve actuated by the same hand simultaneously, especially where a cup rest is not present or convenient or the operator has only one free hand. Prior art pre-mix valves have means for easier operation but have definite short comings. A solenoid operated valve is known but it entails the cost of that electromechanical adaptation. Downward extending levers that are positioned beneath the valve so as to permit operation in the above described one handed manner are known. However, such valves are configured to essentially require substitution off the existing control lever with a lever that extends downward below the valve nozzle in the opposite direction of the traditional lever. The substituted lever interacts with the internal valve actuating shaft mechanism at the same pivot point. Thus, it confers no, or even less, mechanical advantage with respect to the force required to open the valve than what would be normally present with the standard lever. As is known in the art, pre-mix valves are designed so that the pressure of the beverage, as pushed by the driving gas, bears against the valving mechanism to bias it in the closed position. The force required to overcome this pressure is sufficient that if a typical paper or styrofoam cup is pushed against such a downward extending prior art lever, such cups can be easily crushed or otherwise deformed. As a result, beverage may miss the cup or the cup can be rendered unsuitable for retail sale.

Accordingly, it would be desirable to have a pre-mix dispensing system that is lower in cost than existing systems and performs to consistently present a carbonated beverage with the desired level of carbonation. It would also be desirable to have a pre-mix valve that can be operated in a one handed manner without causing cup damage and to do so without adding significant cost and complexity to the valve.

SUMMARY OF THE INVENTION.

The present invention concerns an improved pre-mix beverage dispensing system including an improved pre-mix tank and valve. The present invention includes means for converting existing pre-mix containers so that over carbonation is eliminated. An elongate collapsible bag is sized to be retained within a conventional stainless steel pre-mix tank. A tank access cover is converted in the present invention to retain a neck of the bag.

In operation pre-mix beverage is filled into the bag through the spout thereof as it is retained in the tank. Pressurized gas is applied within the tank between the side walls thereof and the bag. The bag is in fluid communication with a pre-mix valve, the valve for regulating the flow of beverage into a suitable container, such as a cup. Opening the valve than allows the pressurized gas pushing against the bag to force the beverage contents therefrom to the valve and into the cup. Since the bag eliminates any contact of its beverage contents with the driving gas, no uptake of carbon dioxide can occur. In fact, other gases such as ambient air can be used, in addition to carbon dioxide, as spoiling by contact with oxygen or other contaminants can not occur.

It can also be appreciated that the use of a bag naturally prevents any contact between the beverage and the tank interior. As a direct consequence thereof, the cleaning of the tank becomes is a less critical issue, thereby permitting less costly cleaning procedures between uses.

The present invention for converting an existing tank to the use of a bag, also permits the return of the tank to its original configuration for use in the conventional manner. Thus, the present invention permits the use of the existing stock of pre-mix containers both in the modified form as described herein and in the standard configuration.

An improved pre-mix valve has a modified valve control shaft and compensator. The control shaft includes means for channeling and changing the direction of flow of the beverage from the valve mechanism to the nozzle. The shaft profile is also modified to present less of a cross section to the beverage flow. In addition the compensator includes a more shallow cavity area for reducing turbulent flow therein. The foregoing modifications provide for reducing turbulence, increasing laminar flow and thereby reducing carbonation breakout.

A cup actuated lever is pivotally suspended from the valve for contacting the existing manually operated valve actuating lever for permitting one handed operation. This double lever approach to valve actuation provides the needed mechanical advantage to permit one handed operation wherein stress on the cup is greatly reduced and does so in a cost effective manner.

DESCRIPTION OF THE DRAWINGS

A better understanding of the structure, function, operation, objects and advantages of the present invention can be had by reference to the following detailed description which refers to the following figures, wherein.

DETAILED DESCRIPTION OF THE PREFERRED EMBODIMENTS

Figure 1:
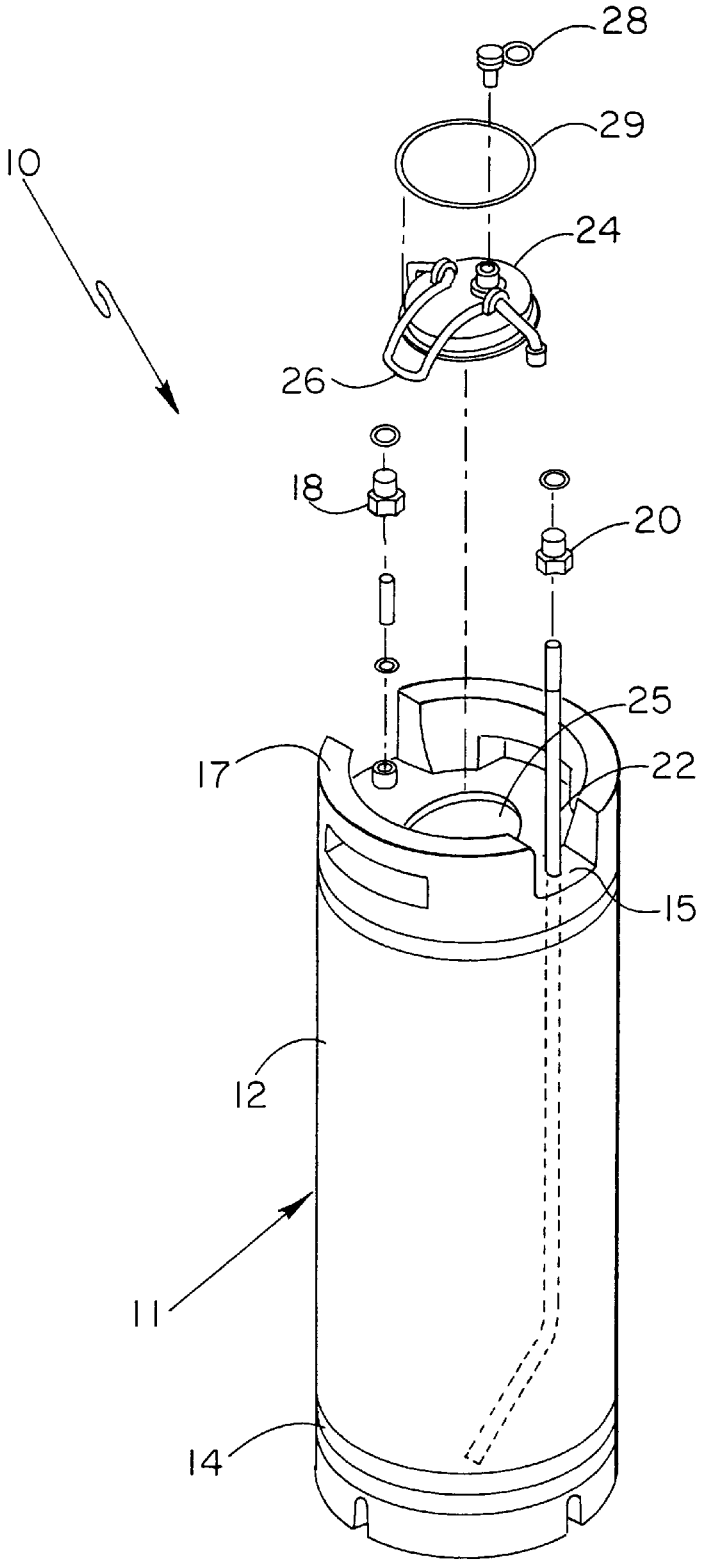
Fig.-1 (PRIOR ART)
FIG. 1 shows a perspective exploded view of a prior art pre-mix tank.
Figure 2:
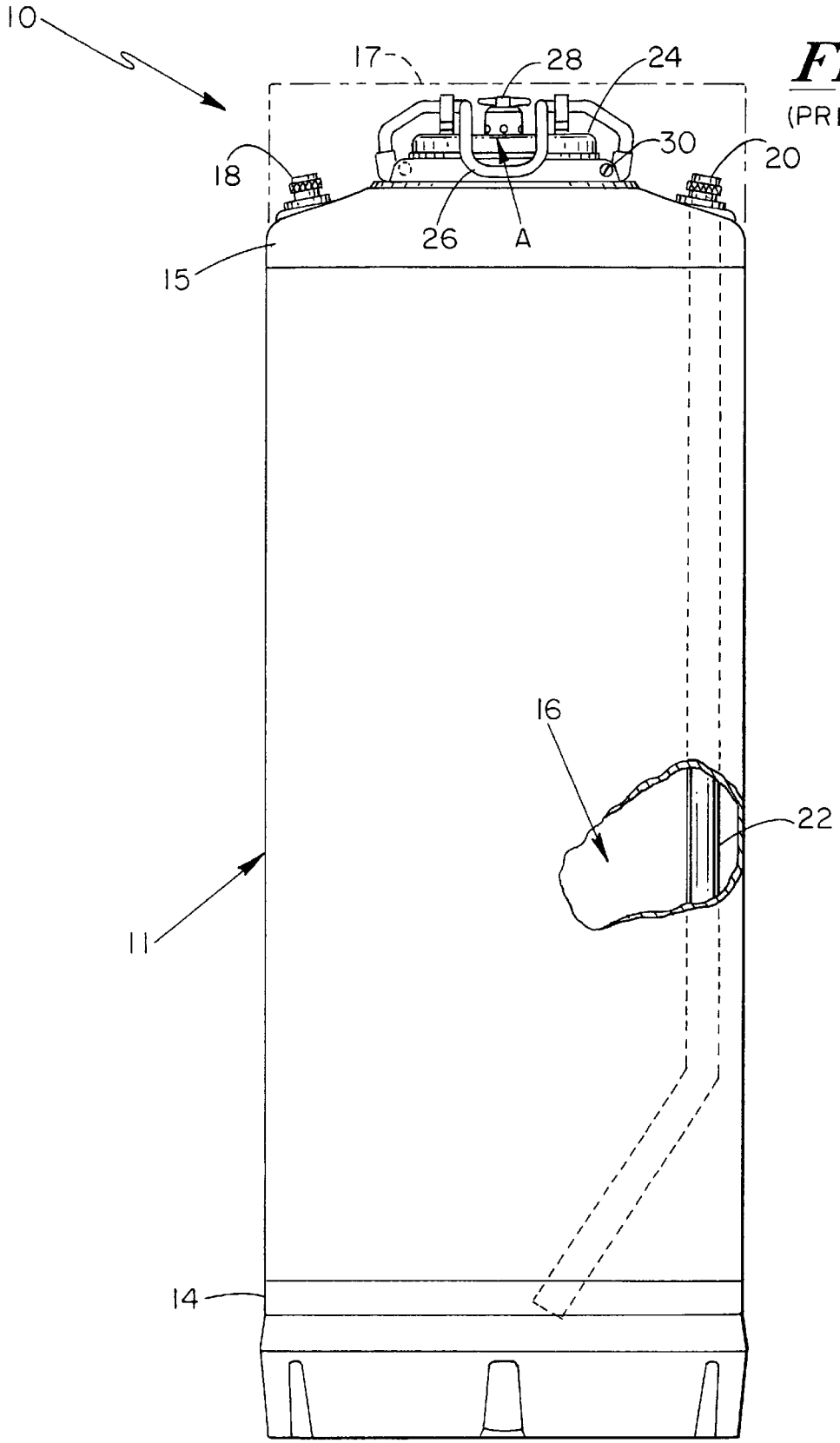
Fig.-2 (PRIOR ART)
FIG. 2 shows a side plan view of a prior art pre-mix tank.

A prior art pre-mix tank is seen in FIGS 1 and 2 and generally referred to by the number 10. Tank 10 includes a main tank portion 11 made of stainless steel that includes sidewalls 12, a base 14 and a top end 15 defining an interior volume 16 and having a handle 17. An inlet 18 provides for attachment to a source of pressurized carbon dioxide gas, and an outlet 20 provides for attachment to a line for delivery of beverage there through from the interior volume 16 to a beverage dispensing means. In that regard, outlet 20 includes a diptube 22 extending downward adjacent base 14. A cover 24 is positioned in a hole 25 extending through top end 15. Cover 24 has a clamp 26 pivotally secured thereto and a relief valve 28 secured to and extending there through. As seen by referring to FIG. 2, an o-ring 29 provides for sealing between cover 24 and tank top end 15.

As is well understood in the art, tank 10 is filled at a bottling facility through outlet 20 which is permitted by the temporary replacement of inlet valve 18 with a snifter valve. To dispense the beverage from the tank requires subsequent connection of a source of pressurized carbon dioxide gas to inlet 18. The gas then forces the beverage through diptube 22 and out of outlet 20 under the regulation of a beverage dispensing valve. Cover 24 is removed by lifting clamp 26 in the direction of arrow A in FIG. 2. Access cover 24 is then removable from hole 25 which provides for a larger opening in tank 10 to facilitate cleaning of its interior volume 16 after depletion of the beverage therefrom and prior to refilling thereof.

Figure 3:
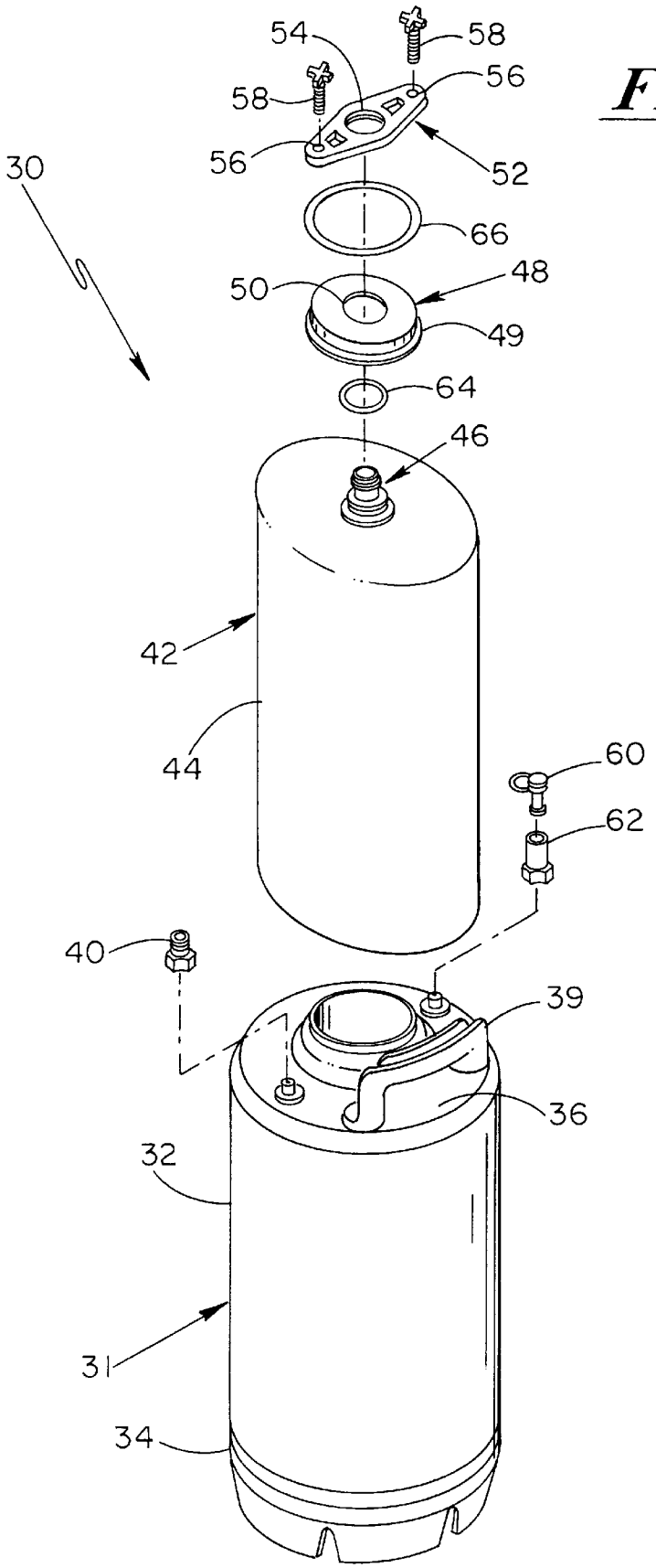
FIG. 3 shows an exploded view of the pre-mix tank of the present invention.
Figure 4:
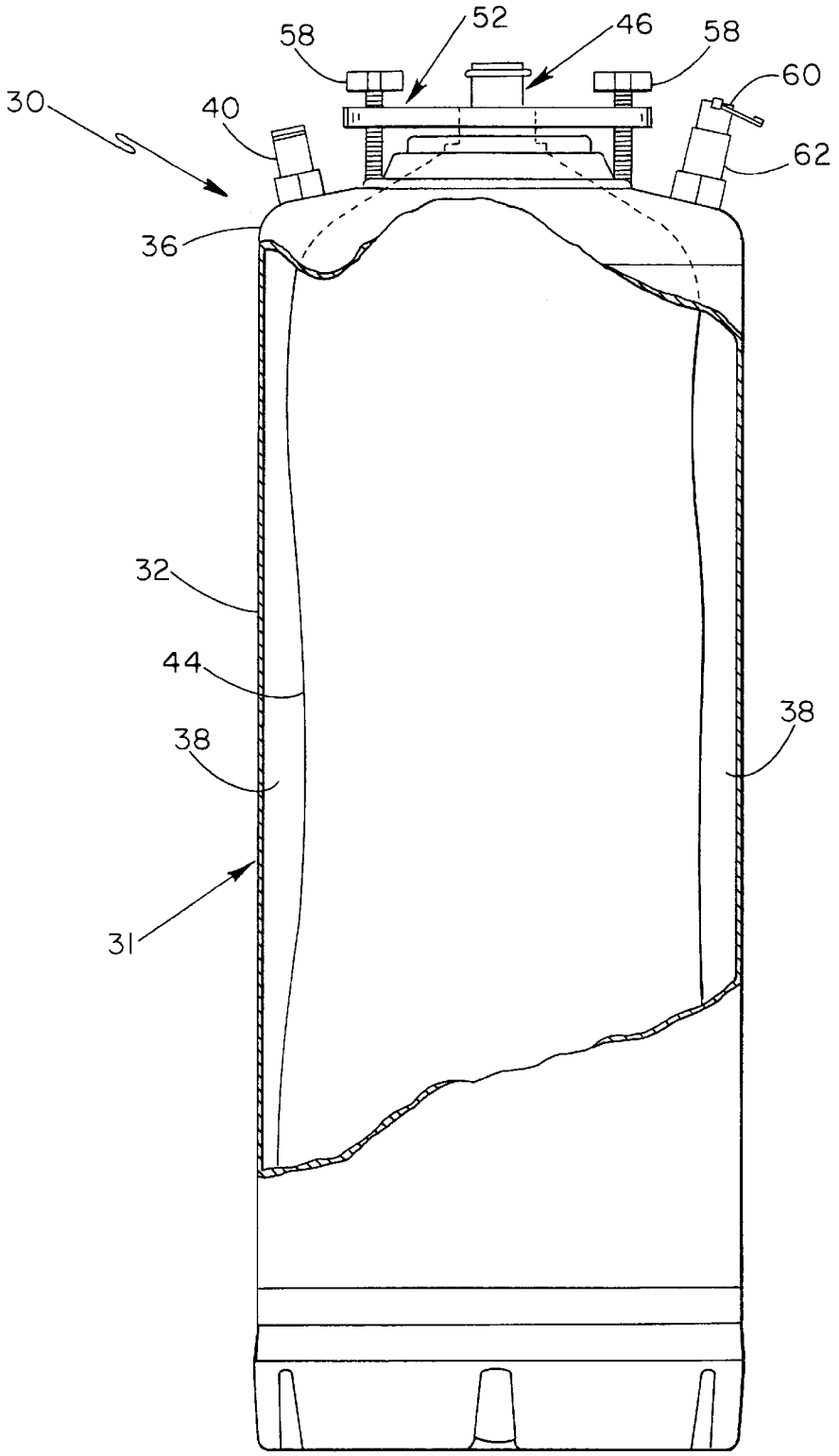
FIG. 4 shows a plan cross-sectional view of the pre-mix tank of the present invention.
Figure 5:
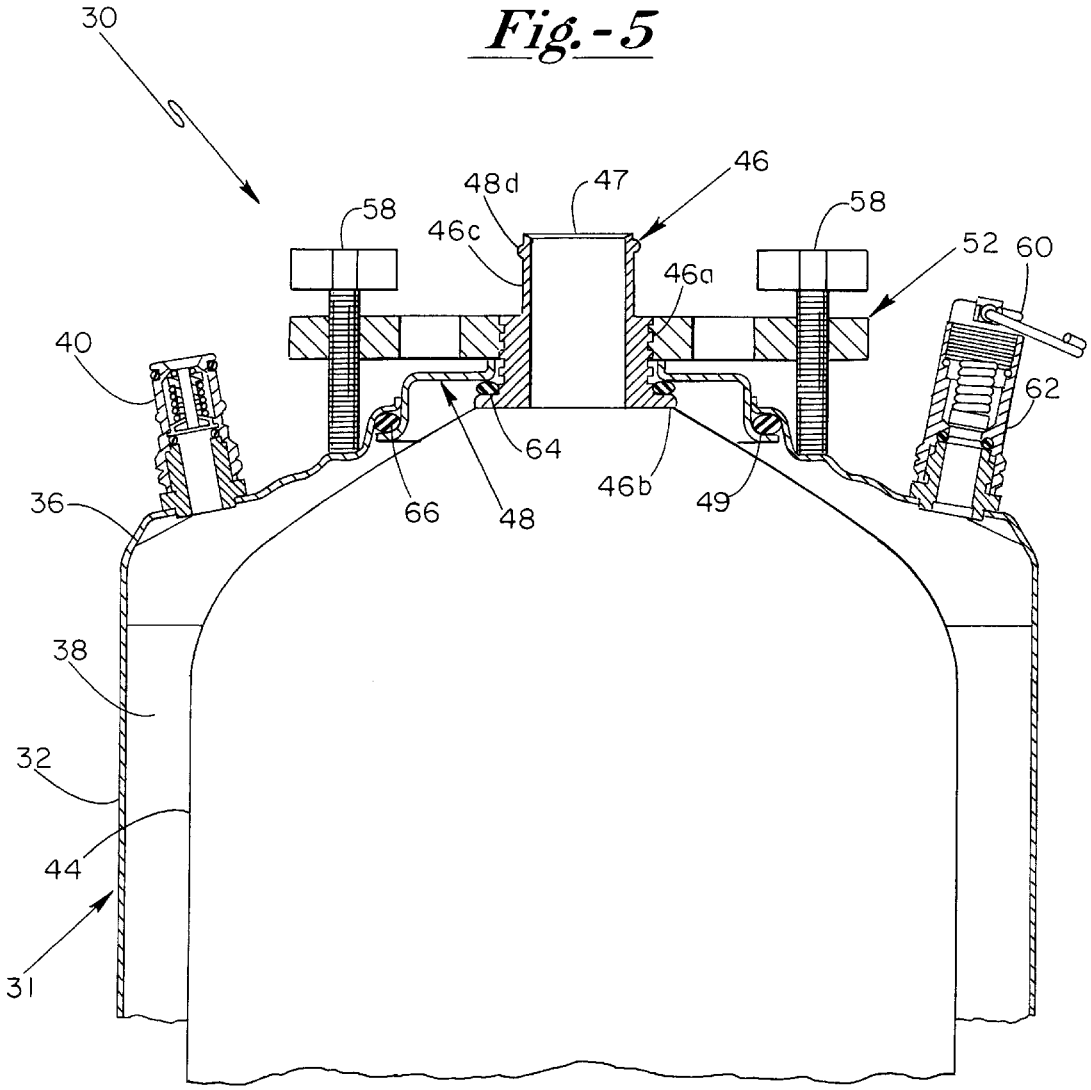
FIG. 5 an enlarged view of the tank of FIG. 4.

As seen by referring to FIGS. 3–5, the pre-mix tank of the present invention is shown and referred to by the number 30. Tank 30, in the same manner as tank 10, includes a main tank portion 31 having sidewalls 32, a base end 34 and a top end 36 defining a tank interior volume 38 and having a handle 39. An inlet fitting 40, also the same as inlet 18 on tank 10, is secured to a tank top end 36. Tank 30 further includes a flexible beverage containing bag 42 having an elongate cylindrical bag portion 44 and a neck 46. Bag 42 is preferably of the multi-layered non gas permeable type used in "bag-in-box" applications wherein, for example, a beverage syrup concentrate is held and used for dispensing in post-mix applications. Neck 46 includes a lower threaded portion **46*a* and an annular flange 46*b*. Neck 46 also include a connection portion 46*c* having an upper thread 46*d*. Neck 46 also includes a seal 47 covering the open end thereof when bag portion 44 is full of beverage and prior to opening thereof. A modified cover 48 includes an annular flange 49, and a central hole 50 for receiving neck portion 36 there through. A bag retaining means is comprised of a yoke 52** having an internally threaded central hole 54 and a pair of internally threaded end holes 56. Holes 56 threadably receive screws 58 therein. A relief valve 60 is threadably received in an adapter 62 which, in turn, is threadably secured to tank 31. An o-ring 64 provides for leak proof sealing between flange 46*b* of neck portion 46 and an annular perimeter of hole 50. A further o-ring 66 provides for fluid tight sealing between cover flange 49 and the perimeter of an opening 68 in tank top end 36.

Figure 23:
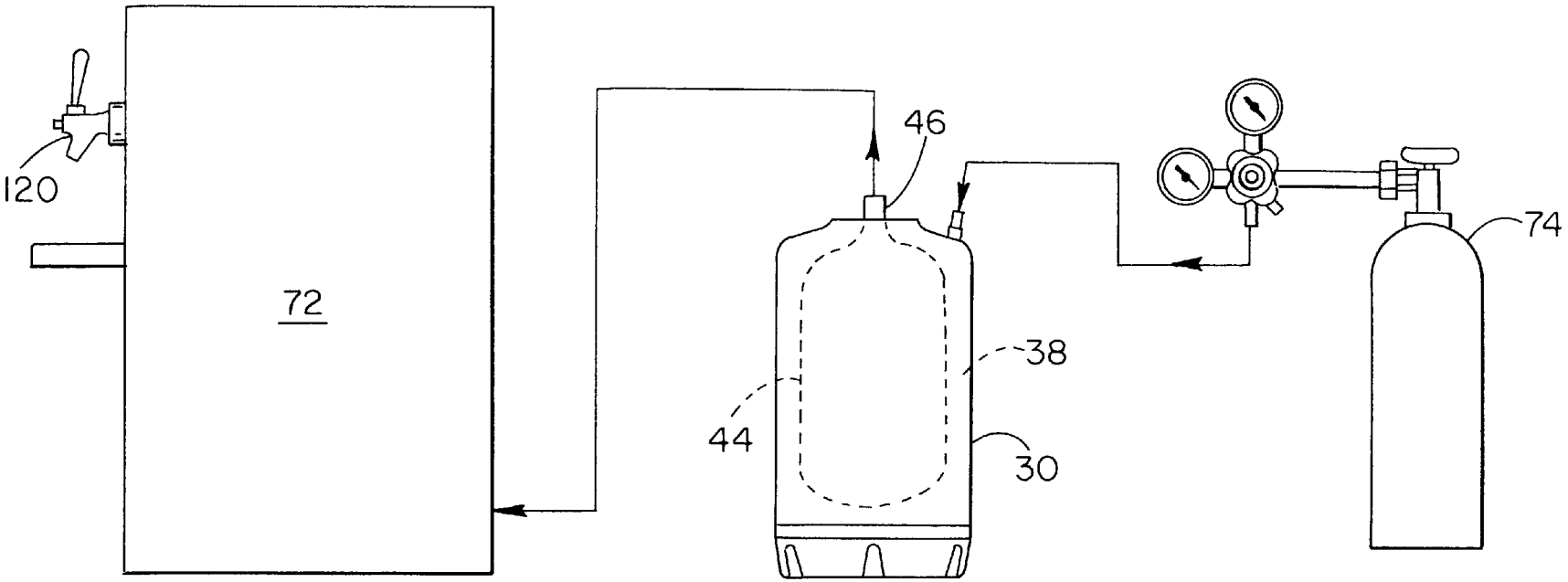
FIG. 23 show a schematic view of the pre-mix dispensing system of the present invention.

In operation, beverage is filled into bag 42 at a bottling facility through connection end 46*c,* after which a contents protecting sealing means is secured to end 46*c* in an aseptic manner. Hole 54 of yoke 52 is engaged with lower threads 46*a* and serves to secure neck 46 firmly against cover 48 wherein o-ring 64 provides for fluid sealing between flange 46*b* and hole 50. Screws 58 can then be tightened to pull cover 48 against tank top end 15 whereby o-ring 66 is compressed forming a fluid tight seal there between. Tank 30 can then be transported to a beverage dispensing location as desired wherein a source of pressurized gas is connected to inlet 40. A bag-in-box fluid coupling, not shown, or other suitable releasable fluid connecting means is secured to connection end 46c. In known systems, such connection automatically ruptures seal 47. As is understood by referring to FIG. 23, the particular fluid connecting means provides for connection to a beverage dispenser means 70 and ultimately to a pre-mix beverage dispensing valve 72. Also, a pressure regulated gas source including a regulator valve 74 and pressurized tank 75 provides pressurized gas to the area within volume 38 between bag portion 44 and the rigid housing of tank portion 31. Thus, bag 44 is compressed whereby the beverage contents thereof flows out of neck 46 to a dispenser 70 where it is cooled and ultimately dispensed out of valve 72 into a suitable cup or other receptacle.

A major advantage of the present invention is that the beverage contents of bag 42 does not come into physical contact with the driving gas. Thus, if the driving gas is carbon dioxide, no further gas up take can occur. As a result thereof, over gassing is no longer a problem. In addition, it can be understood that carbon dioxide is not the only gas that could be used, as the concern of any effect thereon, is also eliminated. Therefore, a lower cost bottled gas, or even ambient air, could be used.

It will be apparent to those of skill that a prior art tank, such as tank 10, can be easily converted to tank 30, by substitution of its cover 24 with cover 48, the use of a bag 42 along with its attachment and sealing means, and by removing outlet 20 and substituting it with a relief valve 60. This latter procedure is accomplished by unscrewing outlet 20 and removing diptube 22. Adapter 62 is then threadably secured in place of outlet fitting 20 after which relief valve 60 is secured to adapter 62. Thus, this method of conversion permits the utilization of an existing stock of pre-mix tanks. In addition, this conversion process also permits the reversal thereof so that a tank can be used again in the conventional manner.

It can further be appreciated that as the interior volume 38 of tank 30 does not come into contact with beverage, it is not soiled to a significant extent so that the cleaning thereof is more easily accomplished. Moreover, since there is no food contact with the tank interior, the sterilization thereof would not be necessary. Therefore, there exists a cost saving with respect to cleaning processes with the present invention as compared to the conventional pre-mix beverage cleaning and refilling system. A further advantage with the present system concerns the ability to use a less expensive grade of stainless steel as there is no food contact. In fact, it will be appreciated that materials other than stainless steel could be used, provided they permitted the same performance with respect to temperature and pressure and met the required margins of safety therein.

Figures 6, 7:
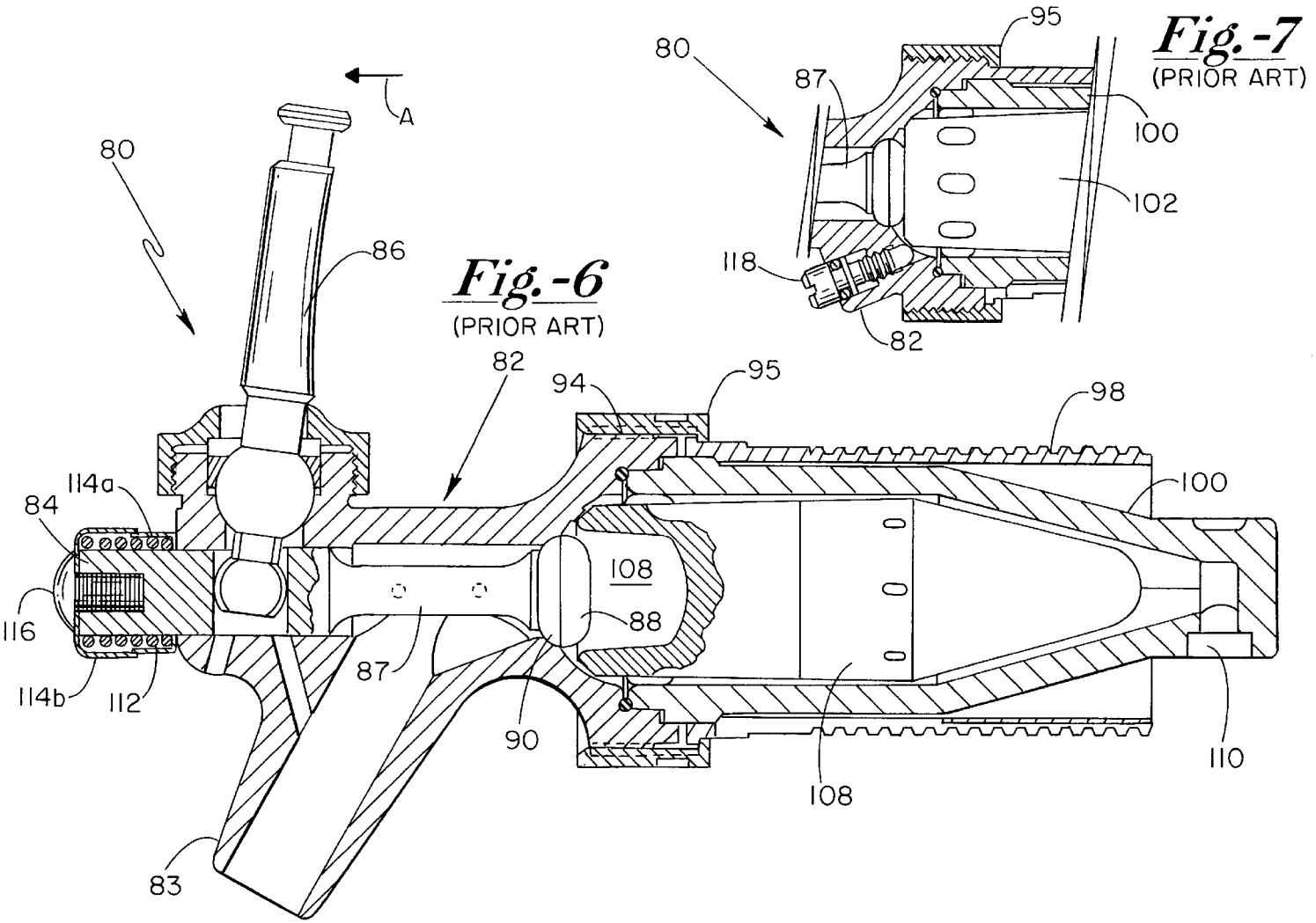
Fig.-7 (PRIOR ART)
Fig.-6 (PRIOR ART)
FIG. 6 shows a cross-sectional view of a prior art pre-mix dispensing valve in the closed position.
FIG. 7 shows a top partial cross sectional view of the valve of FIG. 6.
Figure 8:
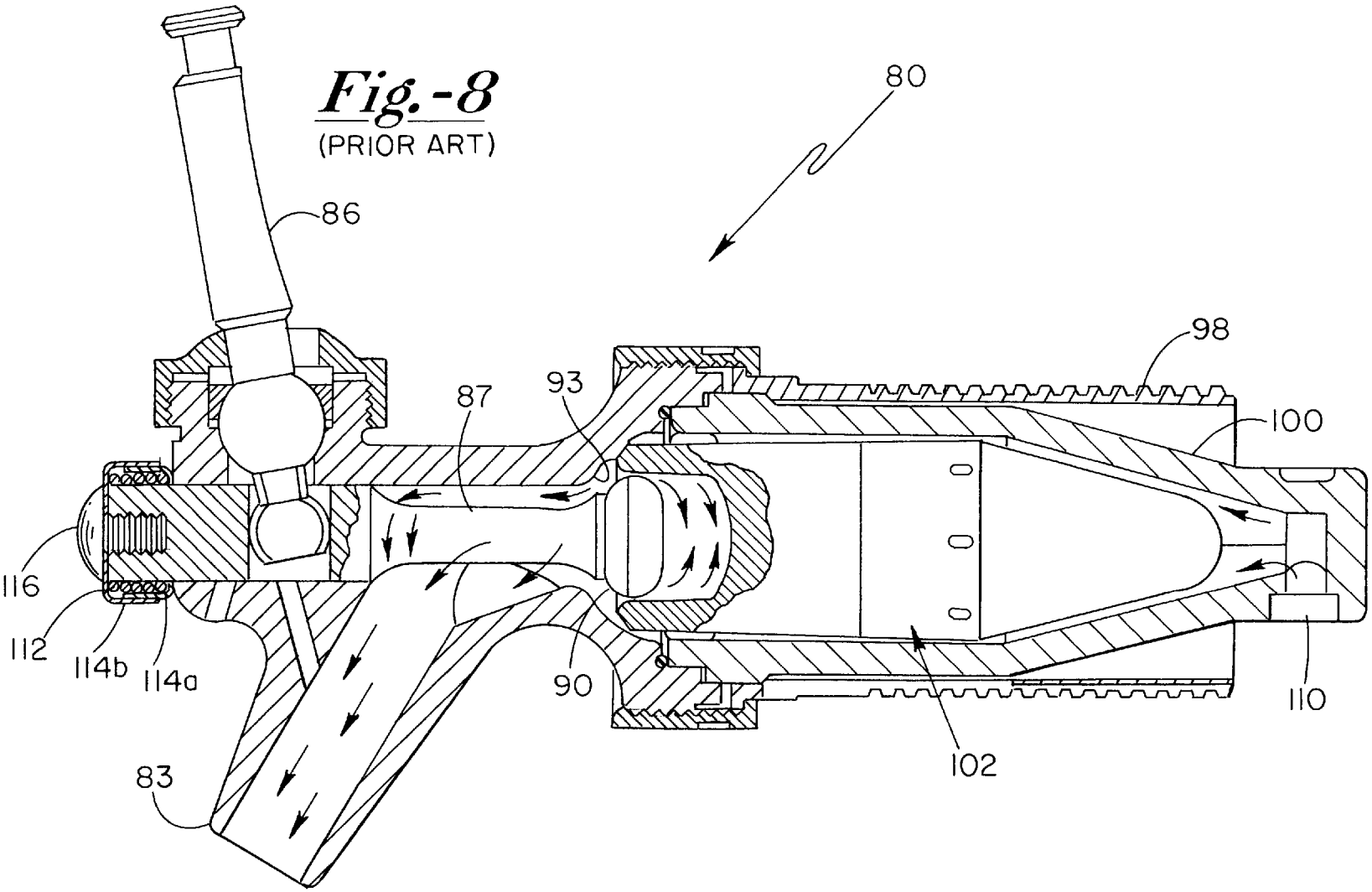
Fig.-8 (PRIOR ART)
FIG. 8 shows a cross-sectional view of a prior art pre-mix dispensing valve in the open position.
Figure 12:
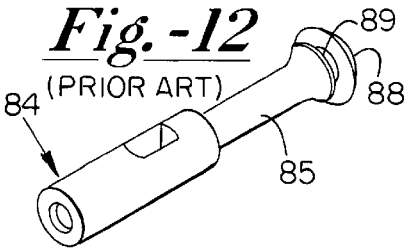
Fig.-12 (PRIOR ART)
FIG. 12 shows a perspective view of a prior art pre-mix valve shaft.
Figure 17:
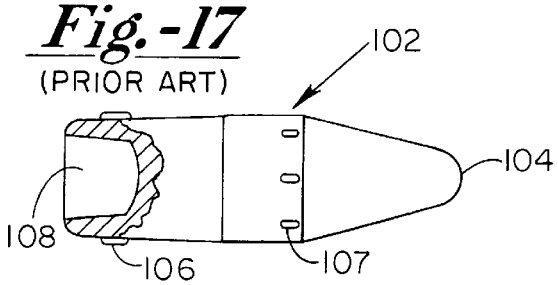
Fig.-17 (PRIOR ART)
FIG. 17 shows a perspective view of a prior art compensator.
Figure 18:
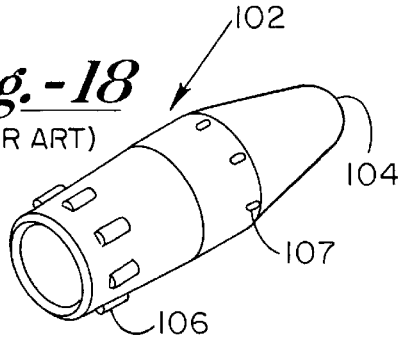
Fig.-18 (PRIOR ART)
FIG. 18 shows a partial cross-sectional view of the compensator of FIG. 14.

Referring to FIGS. 6–8, a prior art pre-mix valve is shown and generally indicated by the numeral 80. Valve 80 includes a housing portion 82 defining a nozzle 83, and in which a valve operating shaft 84 is slideably received and operable by a lever 86. As also understood by referring to FIG. 12, shaft 84 includes a narrowed round flow path portion 85, and an end 88 having an annular groove 89 holding a resilient rubber ring 90 therein. Housing portion 82 includes an internal seat 93 and external threads 94. A threaded ring 96 provides for securing a connecting housing 98 and a compensator housing portion 100 to housing portion 82. An o-ring 101 provides for sealing there between, and held within housing portion 100 is a compensator 102. As understood by also referring to FIGS. 17 and 18, compensator 102 includes a radiused conical end 104, a plurality of spacers 106 and 107 integral with and extending from the surface thereof, and a cavity 108. Inlet housing portion 100 includes an inlet 110 for connection to a source of beverage. A spring 112 is held within retaining means 114*a* and 114*b* by a screw 116 threadably secured to shaft 84. As is also known, and as shown in FIG. 7, an adjustment screw 118 is threadably retained in housing portion 82 and serves to contact an end of compensator 102 and adjust the position thereof within compensator housing 100 for adjusting the rate of flow of beverage through valve 80.

Figures 9, 10:
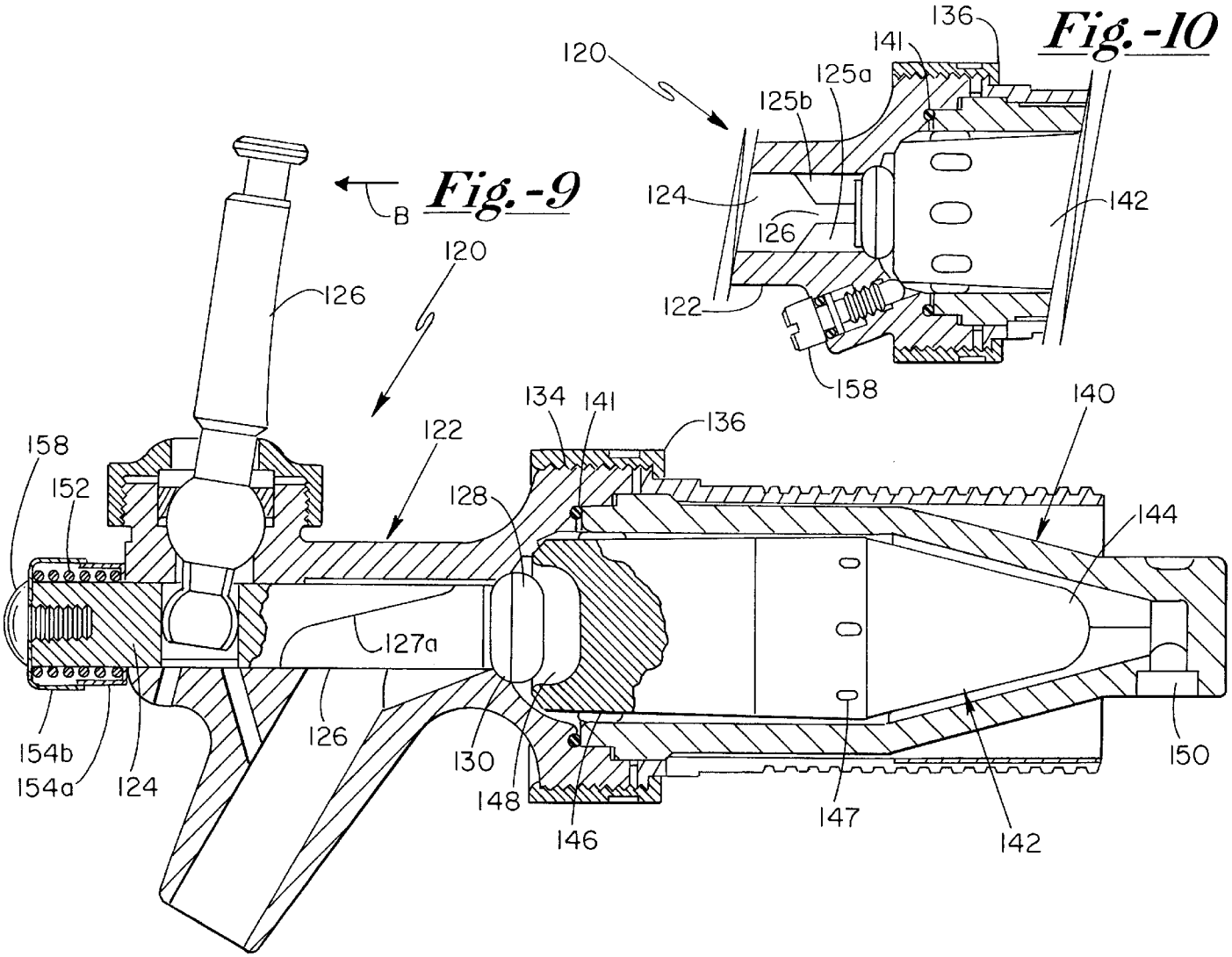
FIG. 9 shows a cross-sectional view of the pre-mix dispensing valve of the present invention in the closed position.
FIG. 10 shows a top partial cross sectional view of the valve of FIG. 9.
Figure 11:
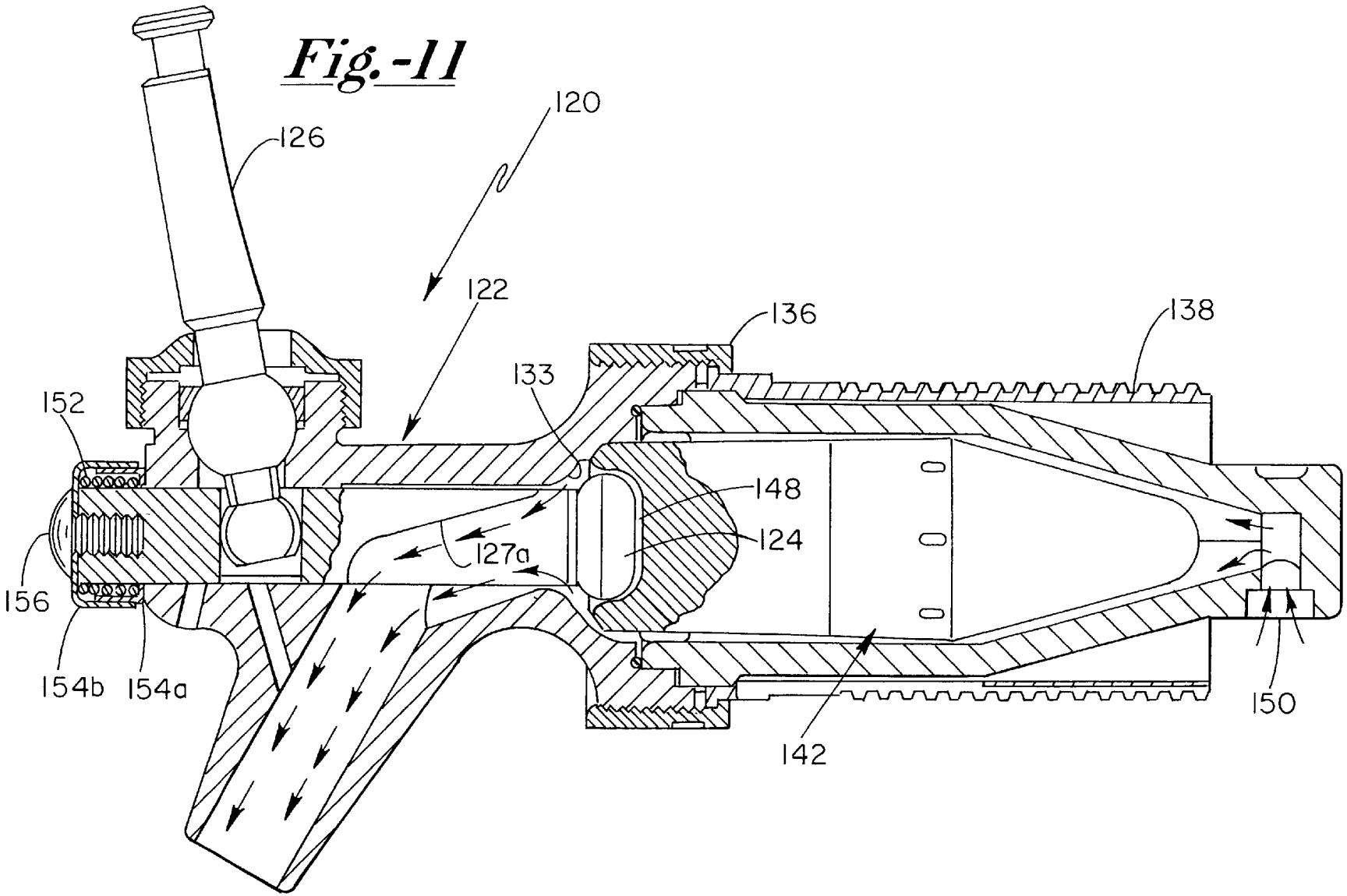
FIG. 11 shows a cross-sectional view of the pre-mix dispensing valve of the present invention in the open position.
Figure 13:
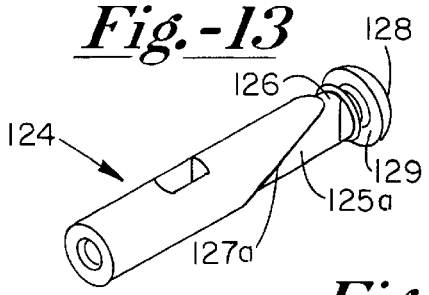
FIG. 13 shows a top perspective view of the shaft of the present invention.
Figure 14:
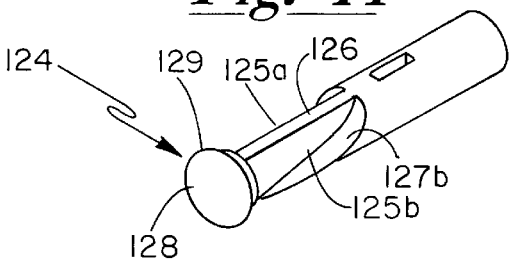
FIG. 14 shows a bottom perspective view of the shaft of the present invention.
Figure 19:
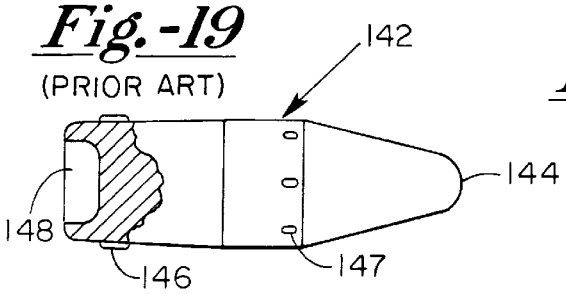
Fig.-19 (PRIOR ART)
FIG. 19 shows a perspective view of the compensator of the present invention.
Figure 20:
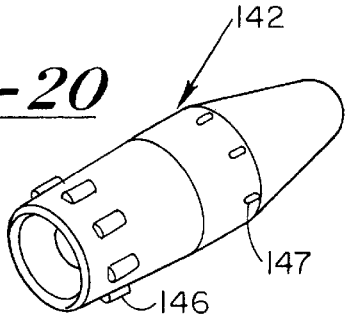
FIG. 20 shows a partial cross-sectional view of the compensator of FIG. 16

Referring to FIGS. 9–11, the improved pre-mix valve of the present invention is shown and is generally indicated by the numeral 120. As with valve 80, valve 120 includes a housing portion 122 defining a nozzle 123, and in which a valve operating shaft 124 is slideably received and operable by a lever 126. However, unlike valve 80, and as can be understood by referring to FIGS. 13 and 14, shaft 124 includes a relieved flow path portion 125. Relieved portion 125 includes two relieved areas 125*a* and 125*b* defined by a narrow shaft section 126 and two arcuate flow path director surfaces 127*a* and 127*b*. Shaft 124 also includes an end 128 having an annular groove 129 holding a resilient rubber ring 130 therein. Housing portion 122 includes an internal seat 133 and external threads 134. A threaded ring 136 provides for securing a connecting housing 138 and a compensator housing portion 140 to housing portion 122. An O-ring 141 provides for fluid sealing there between, and held within housing portion 140 is a compensator 142. As understood by also referring to FIGS. 19 and 20, compensator 142 includes a radiused conical end 144 and a plurality of spacers 146 and 147 integral with and extending from the surface thereof. However, compensator 142 includes a cavity 148 that is substantially shallower that compensator 102 of valve 80. Inlet housing portion 140 includes an inlet 150 for connection to a source of beverage. A spring 152 is held within retaining means 154*a* and 154*b* by a screw 156 threadably secured to shaft 124. As with valve 80, and as shown in FIG. 10, an adjustment screw 158 is threadably retained in housing portion 122 and serves to contact an end of compensator 142 and adjust the position thereof within compensator housing 140 for adjusting the rate of flow of beverage through valve 120.

As is understood by those of skill, valve 80 is operated by movement of lever 86 in the direction of arrow A whereby the valve surface of ring 90 is moved away from its seating relationship with seat 93. Thus, beverage is permitted to flow from inlet 110 around the surface of compensator 102 in the space between it and housing portion 100 as is determined by spacers 106 and 107, then over and around shaft portion 97, and ultimately out of nozzle 83 into a cup. As is known in the art, compensator 102 provides for gently reducing the beverage pressure from that at inlet 110 to that of ambient in a manner that serves to reduce carbonation breakout.

In a similar manner, valve 120 is operated by movement of lever 126 in the direction of arrow B whereby the valve surface of ring 130 is moved away from its seating relationship with seat 133. Thus, beverage is permitted to flow from inlet 150 around the surface of compensator 142 in the space between it and housing portion 140 as is determined by spacers 146 and 157. However, unlike valve 80, when the carbonated beverage reaches shaft portion 125, it is directed by surfaces 127*a* and 127*b* to move through a relatively gradual arc through relieved areas 125*a* and 125*b* and thereby be directed to and out of nozzle 123.

Figure 15:
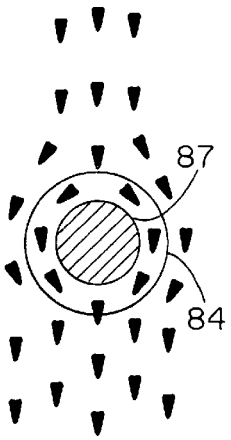
Fig.-15 (PRIOR ART)
FIG. 15 shows a cross sectional view along lines 15—15 of FIG. 12.
Figure 16:
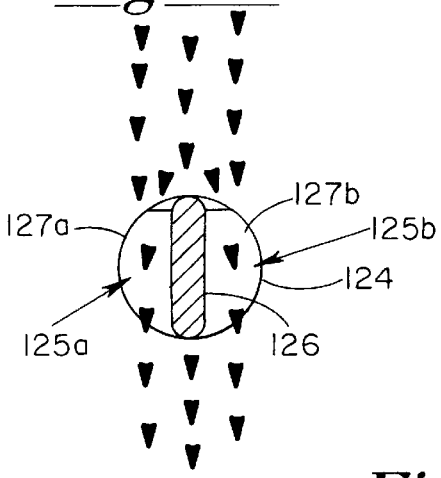
FIG. 16 shows a cross sectional view along lines 16—16 of FIG. 13.

Valve 120 provides for a significant decrease in the loss of carbon dioxide gas from a carbonated beverage dispensed therefrom with respect to prior art valves. It is believed that this improvement in carbonation retention is the result of a variety of factors attributable to the improved design thereof. By again referring to FIG. 11, it can be understood by the plurality of arrows indicating beverage flow, that when valve 120 is in its open position, that arcuate surfaces 127*a* and 127*b* serve to gradually change the direction of the beverage from an essentially horizontal one to a more downward or vertical one. In contrast, as can be understood by to the plurality of arrows in FIG. 8 indicating beverage flow, that when valve 80 is in its open position, the beverage simply hits the area of housing 82 adjacent the end of shaft 84 opposite from seat 93 and then is forced out of nozzle 83. As a result thereof, a carbonated beverage experiences much greater turbulence in this regard than is the case with valve 120. It can also be appreciated by referring to FIGS. 15 and 16, that shaft portion 85 presents a much greater cross-section to the beverage than does the thin profile of shaft portion 126, thus presenting a greater obstruction to flow and inducing more turbulence. It is also thought that the more shallow compensator cavity 148 of valve 120 as opposed to the deeper compensator cavity of 108 of valve 80, reduces any turbulent or extraneous flow in that area as cavity 148 is sized just sufficiently to allow for the motion of shaft end 128. As a consequence of the foregoing, it is believed that valve 120 provides for substantially less turbulent and more laminar flow of a liquid there through so that, in the case of a carbonated beverage, more carbon dioxide gas is retained therein during and a result of the dispensing process.

Figure 21:
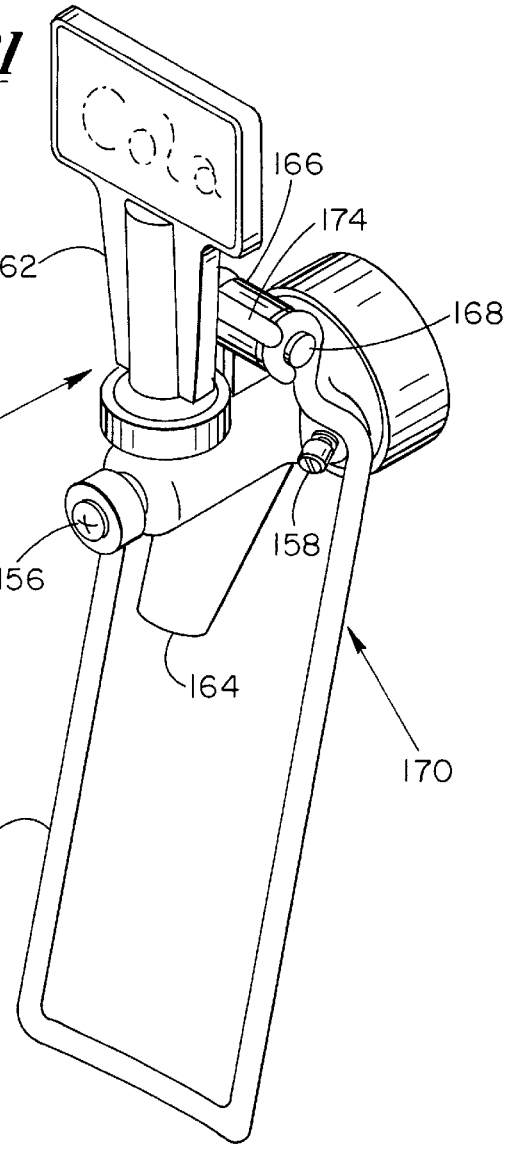
FIG. 21 shows a perspective view of the pre-mix valve of the present invention with the lever operated feature.
Figure 22:
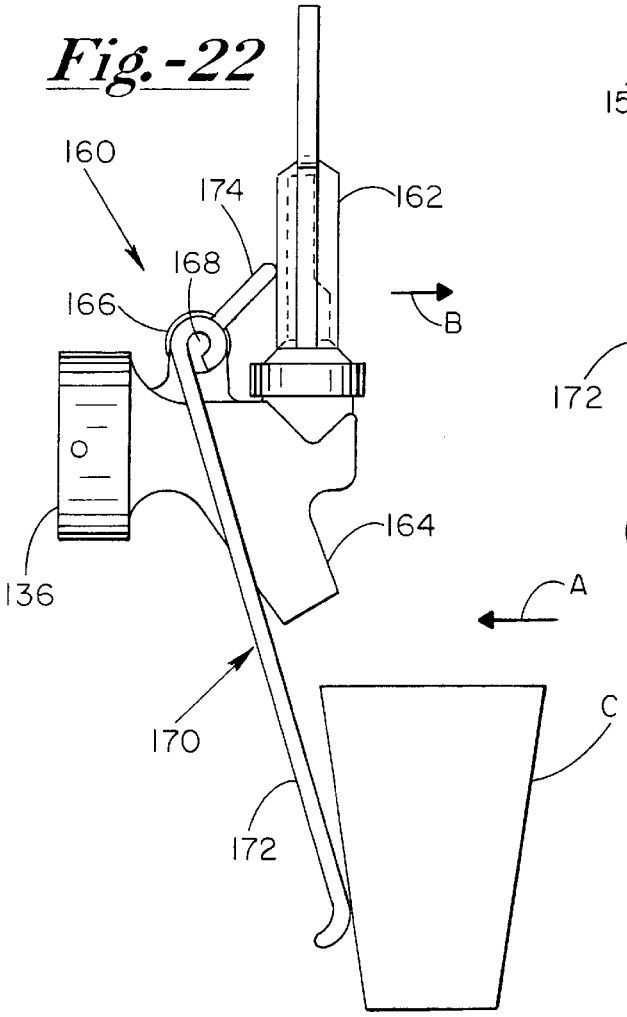
FIG. 22 shows a side plan view along lines 15—15 of FIG. 14.

As seen in FIGS. 21 and 22, a pre-mix dispensing valve is shown and indicated generally by the numeral 160. Valve 160 can be the same internally as valve 120, and includes a similar operating lever 162 and nozzle 164. However, valve 160 also includes a lever mounting extension 166 integral with and extending from a top surface thereof. Extension 166 includes a hole there through for receiving a pin 168 for pivotally mounting a lever 170 thereto. Lever 170 includes a lower cup contacting portion 172 and an angled lever contacting end 174.

In operation, a cup C or other suitable receptacle, is pushed against lever portion 172 in the direction indicated by arrow A in FIG. 22. Contacting end 174 is angled so as to then move lever 162 in the direction of arrow B thereby opening valve 160 so that beverage flows out of nozzle 164 into cup C. As is known in the art, there exists a resistance to the opening of a pre-mix valve as the gas pressure used to move the beverage pushes against, for example, shaft end 128 in valve 120, against which, force must be applied to open the valve. This force is in addition to the biasing force represented by, for example, the shaft closing spring 152. The height or length of lever portion 172 together with contacting end 174 contacting lever 162 at a position there along above its point of pivotal movement, combine to provide a mechanical advantage with respect to the operating of lever 170 to overcome those combined forces. Thus, valve 160 can be opened using a one handed approach wherein a cup can be held by one hand and moved into the cup contacting portion 172 of lever 170 causing beverage to flow into the cup. Moreover, unlike the prior art wherein the lower positioned lever arm was designed to pivot at the same point as the traditional operating lever, the present invention contemplates the use of two separate levers, i.e., a lever to move a lever. Thus, valve 160 permits one handed operation that presents much less stress on the cup being filled.

I claim:

1. A pre-mix beverage dispensing valve, comprising: a valve body for retaining a valve operating shaft therein, the valve operating shaft connected to a lever arm and operable linearly thereby between a valve open position and a valve closed position, the valve operating shaft having a first end for cooperating with a valve seat of the housing body and having a thin profile shaft portion extending in a flow cavity of the valve body, the thin profile shaft portion having arcuate flow directors on each side thereof, the thin profile shaft portion, the flow cavity and the arcuate flow directors defining beverage flow path portions on each side of the thin profile shaft portion for changing a fluid flow from a first direction coextensive with the valve operating shaft to a second direction transverse thereto.

2. The valve as defined in claim 1, and further including a compensator housing in fluid tight connection with the valve body and having a compensator positioned therein and the compensator having a first end adjacent the valve operating shaft first end and the compensator first end having a shallow cavity therein the shallow cavity sized just to permit travel of the valve operating shaft first end therein.

3. A pre-mix beverage dispensing valve, comprising: a valve body for retaining a valve operating shaft therein, the valve operating shaft connected to a lever arm and operable linearly thereby between a valve open position and a valve closed position, the valve operating shaft having a first end for cooperating with a valve seat of the valve body and having a thin profile shaft portion extending in a flow cavity of the valve body, the thin profile shaft portion and the flow cavity defining beverage flow path portions on each side of the thin profile shaft portion for changing a fluid flow of beverage from a first direction coextensive with the valve operating shaft to a second direction transverse thereto.

4. The valve as defined in claim 3, and further including arcuate flow directors integral with and extending from each side of the thin profile shaft for enhancing the change of direction of the fluid flow of the beverage.

5. The valve as defined in claim 3 including a compensator housing in fluid tight connection with the valve body and having a compensator positioned therein and the compensator having a first end adjacent the valve operating shaft first end and the compensator first end having a shallow cavity therein the shallow cavity sized just to permit travel of the valve operating shaft first end therein.

6. The valve as defined in claim 4, and further including a compensator housing in fluid tight connection with the valve body and having a compensator positioned therein and the compensator having a first end adjacent the valve operating shaft first end and the compensator first end having a shallow cavity therein the shallow cavity sized just to permit travel of the valve operating shaft first end therein.

7. A pre-mix beverage dispensing valve, comprising: a valve body for retaining a valve operating shaft therein, the valve operating shaft operable linearly between a valve open position and a valve closed position, the valve operating shaft having a first end for cooperating with a valve seat of the housing body and having a thin profile shaft portion extending in a flow cavity of the valve body the thin profile shaft portion and the flow cavity defining beverage flow path portions on each side of the thin profile shaft portion for changing a fluid flow of beverage from a first direction coextensive with the valve operating shaft to a second direction transverse thereto.

8. The valve as defined in claim 7, and further including arcuate flow directors integral with and extending from each side of the thin profile shaft for facilitating a change of direction of a fluid flow of the beverage from a direction generally coextensive with the valve operating shaft to a direction transverse thereto.

9. The valve as defined in claim 7, and further including a compensator housing in fluid tight connection with the valve body and having a compensator positioned therein and the compensator having a first end adjacent the valve operating shaft first end and the compensator first end having a shallow cavity therein the shallow cavity sized just to permit travel of the valve operating shaft first end therein.

10. The valve as defined in claim 8, and further including a compensator housing in fluid tight connection with the valve body and having a compensator positioned therein and the compensator having a first end adjacent the valve operating shaft first end and the compensator first end having a shallow cavity therein the shallow cavity sized just to permit travel of the valve operating shaft first end therein.

* * * * *